US006267306B1

(12) United States Patent
Phillips et al.

(10) Patent No.: US 6,267,306 B1
(45) Date of Patent: Jul. 31, 2001

(54) FUEL INJECTOR INCLUDING VALVE NEEDLE, INJECTION CONTROL VALVE, AND DRAIN VALVE

(75) Inventors: Ronald Phillips, Hayes; Anthony Thomas Harcombe, Richmond; Andrew Roger Knight, High Wycombe, all of (GB)

(73) Assignee: Lucas Industries, London (GB)

( * ) Notice: Subject to any disclaimer, the term of this patent is extended or adjusted under 35 U.S.C. 154(b) by 0 days.

(21) Appl. No.: 09/395,712

(22) Filed: Sep. 14, 1999

(30) Foreign Application Priority Data

Sep. 18, 1998 (GB) ..... 9820237

(51) Int. Cl.[7] ..... B05B 1/30; F02M 51/00

(52) U.S. Cl. ..... 239/585.1; 239/88; 239/96; 239/127; 239/533.9; 251/129.1; 335/266; 335/268

(58) Field of Search ..... 239/88, 90, 91, 239/96, 124, 127, 533.2, 533.8, 533.9, 585.1; 251/129.09, 129.1, 129.15, 129.16, 129.21; 137/870; 335/232, 266, 267, 268

(56) References Cited

U.S. PATENT DOCUMENTS 4,361,309 * 11/1982 Sogabe ..... 335/267 X
4,964,571 * 10/1990 Taue et al. ..... 239/88
5,463,996 * 11/1995 Maley et al. ..... 239/88 X
5,717,372 2/1998 Cannon et al. ..... 335/265
5,915,624 * 6/1999 Coldren et al. ..... 239/96
6,059,203 * 5/2000 Streicher et al. ..... 239/533.2
6,113,014 * 9/2000 Coldren et al. ..... 239/585.1

FOREIGN PATENT DOCUMENTS 0 823 549 A2 8/1997 (EP) .
0 823 550 A1 2/1998 (EP) .
2 320 292 6/1998 (GB) .

* cited by examiner

*Primary Examiner*—David A. Scherbel
*Assistant Examiner*—Steven J. Ganey
(74) *Attorney, Agent, or Firm*—Wells, St. John, Roberts, Gregory & Matkin, P.S.

(57) ABSTRACT

A fuel injector comprising a valve needle which is slidable within a bore, a surface associated with the valve needle defining, in part, a control chamber which communicates, through a restriction, with a supply passage. The fuel injector also includes an injection control valve controlling communication between the control chamber and a low pressure reservoir, and a drain valve controlling communication between the supply passage and the low pressure reservoir. The injection control valve and the drain valve include respective armatures moveable under the influence of a common electromagnetic actuator.

15 Claims, 3 Drawing Sheets

FUEL INJECTOR INCLUDING VALVE NEEDLE, INJECTION CONTROL VALVE, AND DRAIN VALVE

This invention relates to a fuel injector for use in the delivery of fuel under high pressure to a combustion space of an associated compression ignition engine. The invention relates, in particular, to a fuel injector of the type in which the timing of fuel delivery can be controlled independently of the injection pressure.

In a typical injector of this type, two valves are used, one of the valves controlling the injection pressure, the other valve controlling the timing of commencement and termination of injection. The valve used to control the timing of injection is typically arranged to control the fuel pressure within a control chamber defined, in part, by a surface associated with the injector needle. Termination of injection is achieved by causing the control chamber pressure to rise, forcing the needle into engagement with its seating against a relatively high injection pressure.

Termination of injection in this manner may give rise to unacceptably high levels of smoke and particulate emissions, and it is an object of the invention to provide an injector in which this disadvantage can be avoided.

According to the present invention there is provided a fuel injector comprising a needle slidable within a bore, a surface associated with the needle defining, in part, a control chamber which communicates, through a restriction, with a supply passage, an injection control valve controlling communication between the control chamber and a low pressure reservoir, and a drain valve controlling communication between the supply passage and the low pressure reservoir, wherein the injection control valve and the drain valve include respective armatures moveable under the influence of a common electromagnetic actuator.

The actuator may include separate windings which are energizable independently to cause movement of the armatures. Alternatively, the actuator may include a single winding, energization of the winding to different levels causing movement of the armatures.

In use, the injection control valve may be arranged to open upon de-energization or partial de-energization of the winding(s) to allow the control chamber pressure to fall, thus allowing injection to commence. Alternatively, the injection control valve may be arranged to regulate the control chamber pressure, opening when the control chamber pressure exceeds a predetermined level.

The invention will further be described, by way of example, with reference to the accompanying drawings, in which.

Figure 1:
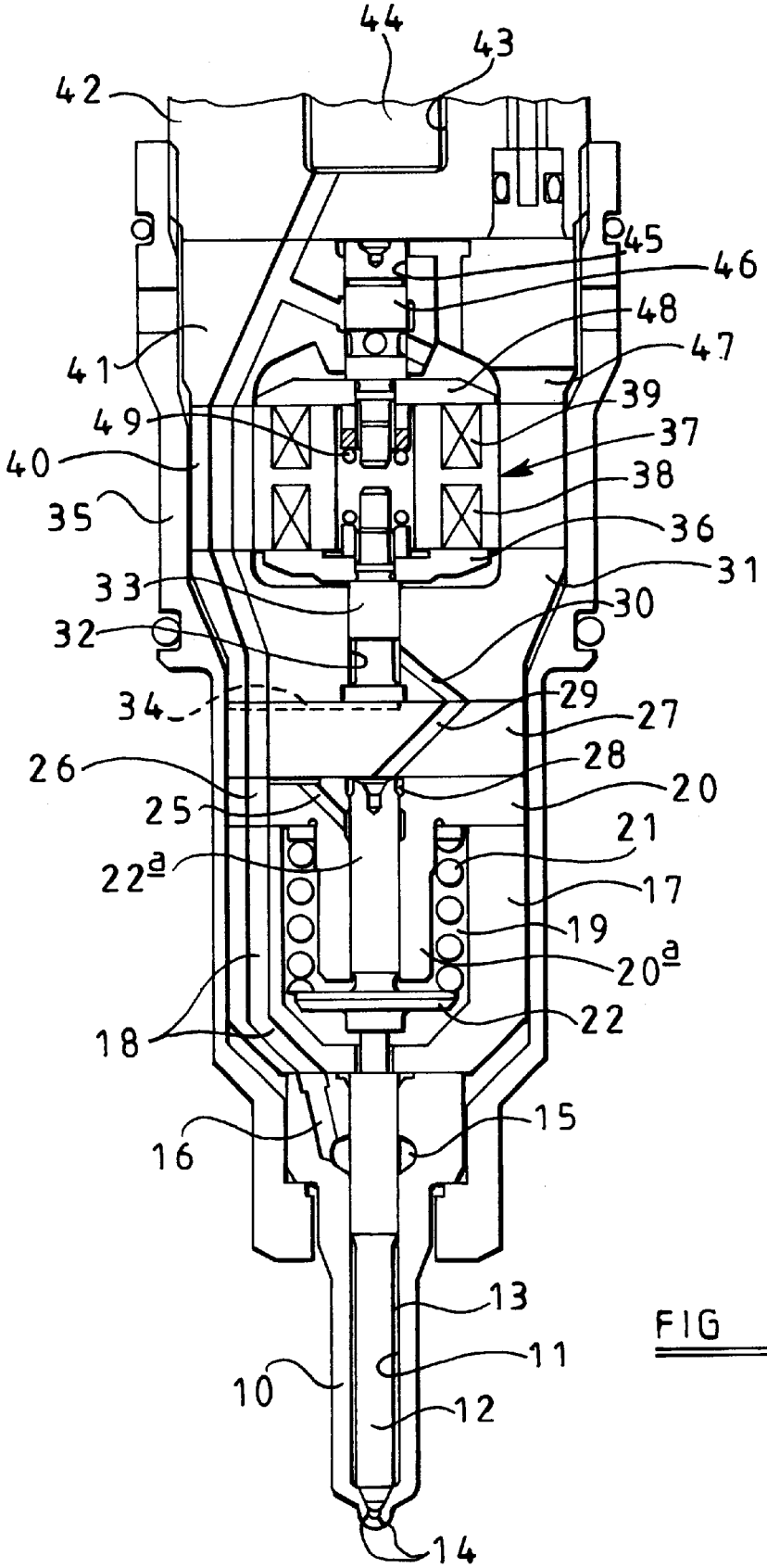
FIG. 1 is a sectional view illustrating part of an injector in accordance with a first embodiment.

FIG. 1 illustrates part of a unit pump injector which comprises a nozzle body 10 having a bore 11 formed therein, a needle 12 being slidable within the bore 11 and engageable with a seating defined adjacent a blind end of the bore 11 to control the flow of fuel from a delivery chamber 13 defined between the needle 12 and the bore 11 to a plurality of outlet openings 14 located downstream of the seating. The needle 12 includes angled thrust surfaces exposed to the fuel pressure within the delivery chamber 13, thus the application of fuel under high pressure to the delivery chamber 13 applies a force to the needle 12 urging the needle 12 away from its seating.

The bore 11 includes a region of enlarged diameter which defines an annular gallery 15. The gallery 15 communicates with a drilling 16 forming part of a supply passage. Flutes or other formations are provided in the needle 12 to permit fuel to flow from the gallery 15 to the delivery chamber 13, the needle 12 further including regions of diameter substantially equal to the diameter of the adjacent parts of the bore 11 to guide the needle 12 for sliding movement within the bore 11.

The end of the nozzle body 10 remote from the blind end of the bore abuts a spring housing 17. The spring housing is provided with drillings 18 which form part of the supply passage. The spring housing 17 is provided with a through bore including a region of enlarged diameter which defines a spring chamber 19, the spring chamber 19 being closed by a closure member 20 which abuts the end surface of the spring housing 17 remote from the nozzle body 10. A spring 21 is located within the spring chamber 20, the spring 21 extending between the closure member 20 and an abutment member 22 which abuts a projection extending from an upper part of the needle 12 which extends into the spring chamber 19. The spring 21 therefore applies a biasing force to the needle 12, urging the needle 12 into engagement with its seating.

The spring abutment member 22 includes a region 22*a* which is slidable within a bore formed in a projection 20*a* of the closure member 20. The region 22*a* is of piston-like fit within the bore of the projection 20*a*.

Intermediate its ends, the bore of the projection 20*a* is provided with a region of slightly enlarged diameter which defines, with the region 22*a*, an annular chamber which communicates through a drilling 25 and a groove formed in the upper surface of the closure member 20 with a drilling 26 forming part of the supply passage.

The surface of the closure member 20 remote from the spring housing 17 abuts a first distance piece 27. The distance piece 27, closure member 20 and region 22*a* together define a control chamber 28 which communicates via a restricted or controlled clearance between the region 22*a* and the wall of the bore of the closure member 20 with the annular chamber which communicates with the drilling 25. It will be appreciated, therefore, that fuel is able to flow at a restricted rate from the supply passage to the control chamber 28.

The control chamber 28 further communicates with a drilling 29 formed in the distance piece 27, the drilling 29 communicating with a drilling 30 formed in a control valve housing 31 which abuts the surface of the distance piece 27 remote from the closure member 20. The drilling 30 opens into a through bore 32 formed in the control valve housing 31, a control valve member 33 being sidable within the through bore 32 and including a region of enlarged diameter which is engageable with a seating defined around part of the through bore 32 to control communication between the drilling 30 and a groove 34 formed in the upper surface of the distance piece 27, the groove 34 communicating with a low pressure chamber defined, in part, between the control valve housing 31 and a cap nut 35. In use, the low pressure chamber communicates with an appropriate fuel reservoir or drain.

The control valve member 33 carries an armature 36 which is moveable under the influence of the magnetic field generated, in use, by an actuator arrangement 37 including first and second windings 38, 39. The actuator arrangement 37 is located within an actuator housing 40 which abuts the control valve housing 31. A drain valve housing 41 abuts the surface of the actuator housing 40 remote from the control valve housing 31, the drain valve housing 41 abutting a pump housing 42 including a bore 43 within which a pumping plunger 44 is reciprocable under the influence of a cam and tappet arrangement (not shown) and a return spring (not shown). The bore 43 communicates with the supply passage. The cap nut 35 is secured to the pump housing 42, the cap nut 35 securing the nozzle body 10, the spring housing 17, the closure member 20, the distance piece 27 and the control valve, actuator and drain valve housings 31, 40, 41 to the pump housing 42.

The drain valve housing 41 includes a through bore 45 within which a drain valve member 46 is slidable, the drain valve member 46 being engageable with a seating to control communication between the supply passage and a passage 47 formed in the drain valve housing 41 which communicates with the low pressure drain reservoir, in use. The drain valve member 46 is secured to an armature 48 moveable under the influence of the magnetic field generated, in use, by the second winding 39 of the actuator arrangement 37. A spring 49 is located between the armature 36, 48, appropriate shins being located to achieve the desired level of pre-stressing of the spring 49, the spring 49 urging both the drain valve member 46 and the control valve member 33 away from their seatings towards respective open positions.

Starting from the position in which the plunger 44 occupies its innermost position and in which the actuator arrangement 37 is de-energized, the fuel pressure within the bore 43 and the supply passage is relatively low, and injection of fuel is not taking place. The plunger 44 is retracted from the bore 43 under the action of the return spring, such retraction of the plunger 44 drawing fuel into the plunger bore 43 from the drain reservoir past the drain valve member 46. The movement of the plunger 44 therefore charges the plunger bore 43 with fuel. Once the plunger 44 has reached its outermost position, the plunger 44 will commence inward movement under the action of the cam and tappet arrangement. Whilst the actuator arrangement 37 remains de-energized, such inward movement of the plunger 44 simply displaces fuel past the drain valve member 46 to the low pressure drain. The fuel pressure within the bore 43 and the supply passage therefore remains relatively low, and is unable to lift the injector needle 12 away from its seating against the action of the spring 21.

When it is determined that pressurization of fuel is to commence in order to achieve the desired injection pressure at the appropriate point in the operating cycle of the injector, the actuator arrangement 37 is energized, energizing both the first and second windings 38, 39 thereof. Such energization causes the armatures 36, 48 to move towards the actuator arrangement 37, compressing the spring 49 and moving the drain valve member 46 and control valve member 33 into engagement with their respective seatings. As a result, fuel is unable to flow past the drain valve member 46 to the low pressure drain. The continued inward movement of the plunger 44 is therefore unable to displace fuel to the low pressure drain, and the continued movement results in pressurization of the fuel within the plunger bore 43 and the passages and chambers in communication therewith. The increase in the fuel pressure results in the fuel pressure within the control chamber 28 rising, fuel being unable to escape from the control chamber 28 as the control valve member 33 engages its seating. As the fuel pressure within the control chamber 28 is relatively high, a relatively large magnitude force is applied to the needle 12 assisting the spring 21 in ensuring that the needle 12 remains in engagement with its seating, thus injection of fuel does not take place, even though the delivery chamber pressure is rising.

When injection of fuel is to commence, the first winding 38 of the actuator 37 is de-energized, and as a result, the control valve member 33 moves under the action of the spring 49 to permit fuel to escape from the control chamber 28 to the low pressure drain. The armature 48 of the drain valve does not move, and so the drain valve member 46 remains in engagement with its seating.

The communication between the control chamber 28 and the low pressure drain permits the fuel pressure within the control chamber 28 to fall, thus reducing the magnitude of the force applied to the needle 12 urging the needle 12 towards its seating, and a point will be reached beyond which the fuel under pressure within the delivery chamber 13 is able to lift the needle 12 away from its seating, thus permitting fuel to flow to the outlet openings 14 the fuel then being delivered to the combustion space of an associated engine.

During injection, fuel is able to flow at a restricted rate to the control chamber 28, but the rate at which fuel is able to flow to the control chamber 28 is insufficient to maintain the fuel pressure within the control chamber 28 at a sufficiently high level to prevent movement of the needle 12.

Movement of the needle 12 away from its seating is limited by engagement of the end part of the region 22*a* with the first distance piece 27. Such engagement closes the drilling 29, thus breaking the communication between the control chamber 28 and the low pressure drain. As a result, the fuel pressure within the control chamber 28 is able to rise. However, it will appreciated that at this point in the operating cycle of the injector, the increased fuel pressure acts upon only a relatively small effective area, thus the magnitude of the force applied to the needle 12 by the fuel pressure within the control chamber 28 is insufficient to terminate injection. In order to assist in ensuring that communication between the control chamber 28 and the drilling 29 is broken at this point in the operating cycle of the injector, the region 22*a* is conveniently shaped to define a seating which forms a good seal with the adjacent surface of the distance piece 27.

In order to terminate injection, the actuator 37 is totally de-energized, and as a result the drain valve member 46 is able to move away from its seating under the action of the spring 49. Such movement permits fuel to escape to the low pressure drain reservoir and as a result, the fuel pressure within the delivery chamber 13 falls. The fuel pressure within the delivery chamber 13 falls to an extent sufficient to allow the spring 21 to return the needle 12 into engagement with its seating, thus terminating the supply of fuel to the outlet openings 14 and terminating injection. Continued inward movement of the plunger 44 continues to displace fuel past the drain valve member 46 to the low pressure drain until the plunger 44 reaches its innermost position, thereafter the plunger 44 being retracted from the bore 43 as described hereinbefore.

It will be appreciated that as the termination of injection is achieved by opening the drain valve and reducing the fuel pressure within the delivery chamber 13, the needle 12 moves into engagement with its seating against a relatively low fuel injection pressure, thus the risk of emission of unacceptably high levels of smoke and particulates is reduced.

If the injector is used in an arrangement in which it is desired to achieve a pilot injection followed by a main injection, then the injection cycle may be modified by interrupting the injection when the quantity of fuel desired to be delivered during the pilot injection has been delivered by re-energizing the first winding 38 of the actuator 37 to return the control valve member 33 to its closed position, such movement permitting the fuel pressure within the control chamber 28 to rise to an extent sufficient to cause the needle 12 to return into engagement with its seating. Subsequently, the main injection is commenced by de-energizing the first winding 38 to relieve the fuel pressure within the control chamber 28. Termination of injection is as described hereinbefore. It will be appreciated that in order to permit the injector to be operated in this manner, the injector must be modified to ensure that the drilling 29 remains in communication with the control chamber 28 even when the needle 12 occupies its fully lifted position.

Although in the description hereinbefore, the actuator arrangement 37 is described as including separate first and second windings 38, 39, it will be appreciated that by appropriately modifying the spring arrangement used to bias the valves towards their open positions, the injector may be controlled using an actuator arrangement including a single winding, energization of the winding to a high level attracting both armatures towards the actuator to close both valves, energization of the actuator to a lower level generating an attractive force sufficient to retain the drain valve in its closed position, but insufficient to hold the control valve member in its closed position.

Figure 2:
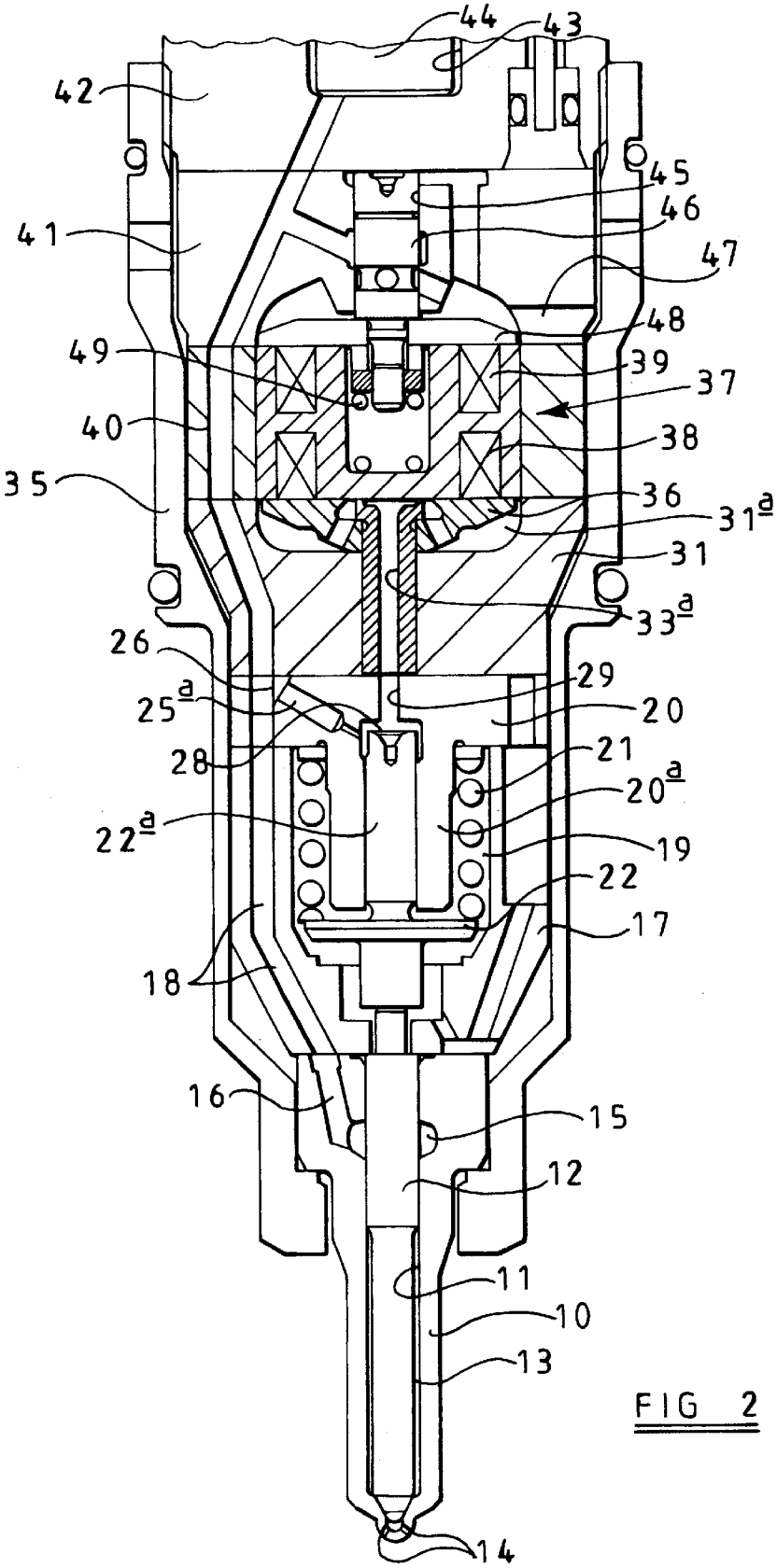
FIG. 2 is a view similar to FIG. 1 illustrating an alternative embodiment.

The injector illustrated in FIG. 2 is similar to that of FIG. 1, and only the modifications thereto will be described in detail. In the injector of FIG. 2, the injection control valve member 33 takes tile form of a tubular valve member, the upper end of which is engageable with a surface of the actuator arrangement 37 to control communication between the control chamber 28 and a chamber 31*a* defined, in part, by the control valve housing 31 which communicates with the low pressure drain reservoir. In this embodiment, the control valve member 33 is not spring biased towards an open position.

In use, the charging of the bore 43 with fuel and the commencement of pressurization of fuel are as described hereinbefore. Commencement of injection occurs in a somewhat different manner.

Once pressurization of fuel has commenced, it will be appreciated that the fuel pressure within the control chamber 28 rises. A passage 33*a* of tile tubular valve member 33 communicates with the control chamber 28, and so is exposed to substantially the same fuel pressure. As illustrated, the upper end of the passage 33*a* is of enlarged diameter, and the application of fuel under pressure to the passage 33*a* of the valve member 33 applies a force to the valve member 33 urging the valve member 33 away from the actuator arrangement 37 against the action of the magnetic attraction between the actuator arrangement 37 and the armature 36. As the fuel pressure within the control chamber 28 rises, a point will be reached beyond which the valve member 33 is able to lift away from the actuator arrangement 37 against the action of the magnetic attraction, thus permitting fuel to escape, and regulating the fuel pressure within the control chamber 28 so that the fuel pressure within the control chamber 28 is related to the magnitude of the attractive force between the actuator arrangement 37 and the armature 36.

The magnitude of the attractive force can be controlled, for example, by controlling the current flowing in the winding 38.

As the plunger 44 continues to move inwardly, the fuel pressure within the injector, and in particular within the delivery chamber 13 rises. As the fuel pressure within the control chamber 28 is regulated in the manner described hereinbefore, the increasing fuel pressure within the delivery chamber 13 will reach a point beyond which the action of the fuel pressure within the delivery chamber 13 upon the thrust surfaces of the needle 12 will apply a sufficiently large force to the needle 12 to permit the needle 12 to lift away from its seating against the action of the fuel under pressure within the control chamber 28 and the action of the spring 21. Clearly, as the magnitude of the fuel pressure within the control chamber 28 is dependent upon the magnitude of the attractive force between the actuator 37 and the armature 36, the fuel pressure within the delivery chamber 13 which causes the needle 12 to lift away from its seating to commence injection can be controlled by controlling the level of energization of the winding 38.

Once injection has commenced, the region 22*a* moves into engagement with a seating defined by a shoulder of the closure member 20 to break communication between the control chamber 28 and the passage 33*a* of the valve member 33. As a result, further fuel is unable to escape from the supply passage through the control chamber 28 to the low pressure drain.

When it is determined that injection should be terminated, the actuator 37 is totally de-energized, thus allowing the drain valve member 46 to lift away from its seating and permitting fuel to escape to the low pressure drain. As a result, the fuel pressure within the delivery chamber 13 reduces, and a point will be reached beyond which the needle 12 is able to return into engagement with its seating under the action of the spring 21.

The arrangement illustrated in FIG. 2 is advantageous in that the timing of fuel injection is governed by the timing at which the fuel pressure within the system reaches a predetermined pressure controlled by the energization of the first winding 38, rather than by controlling the timing at which the first winding 38 is de-energized. The control system used to control operation of the injection can therefore be simplified.

In the embodiment illustrated in FIG. 2, the restricted communication between the supply passage and the control chamber 28 is by way of a direct, restricted drilling 25*a* rather than by way of a controlled clearance between the region 22*a* and the bore of the projection 20*a*. As a result, the manufacturing process may be simplified. It will be appreciated that this modification may also be incorporated in the arrangement of FIG. 1.

If desired, as with the arrangement illustrated in FIG. 1, the actuator 37 may be modified to include a single winding, the actuator being arranged such that when pressurization of fuel is to commence, the actuator is fully energized to attract both armatures towards the actuator. The energization level of the actuator may be chosen to ensure that the drain valve member 46 remains in engagement with its seating and to ensure that the control valve member 33 is able to lift away from its seating at the appropriate point in the injection cycle. Alternatively, after initial energization of the actuator, the energization level may be reduced to allow the control valve member 33 to move away from the actuator to permit commencement of injection, the energization level still being sufficient to ensure that the drain valve member 46 remains in engagement with its seating.

Figure 3:
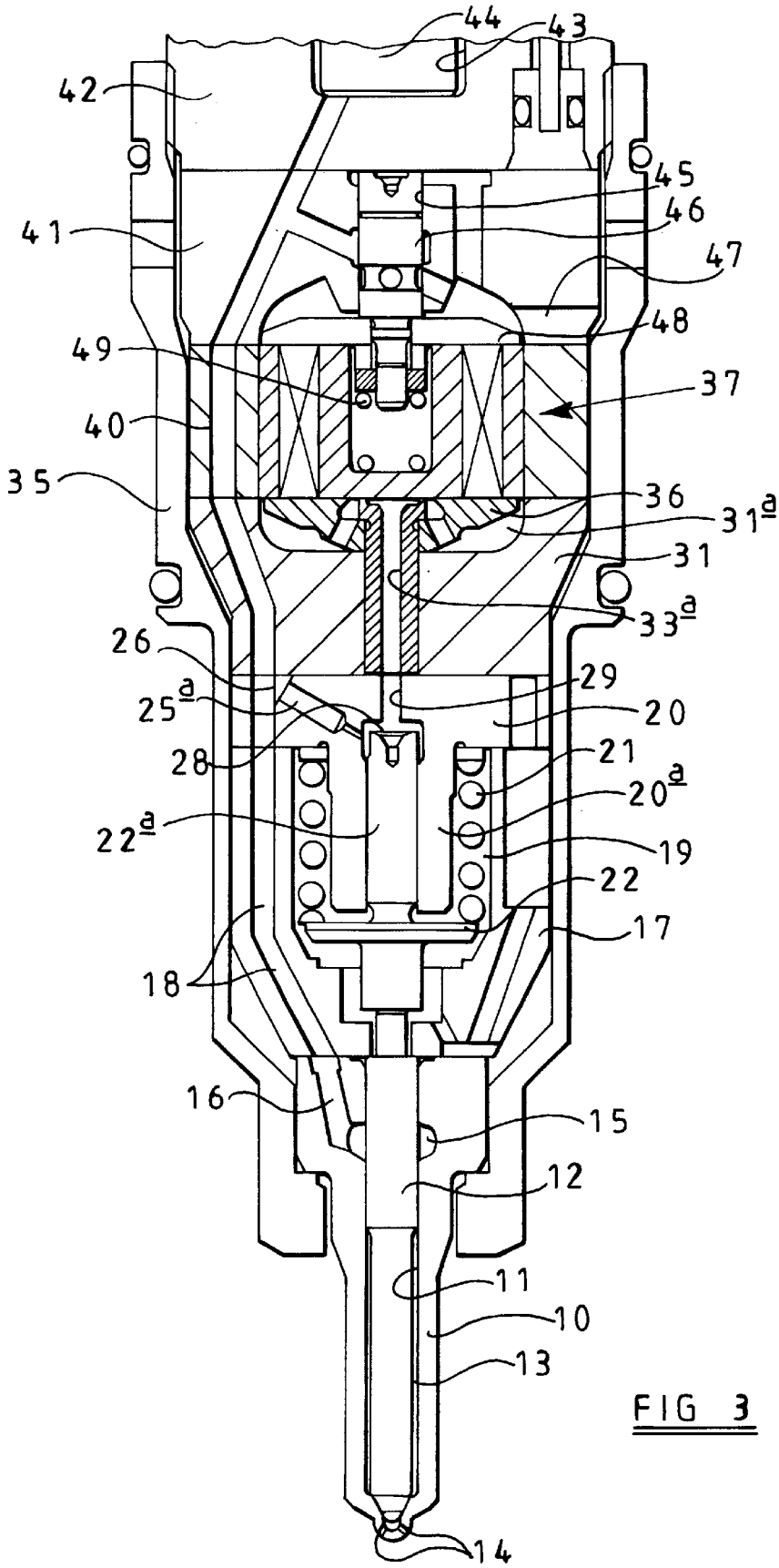
FIG. 3 is a view similar to FIG. 2 illustrating another alternative embodiment.

FIG. 3 illustrates an embodiment similar to the embodiment of FIG. 2, like reference numerals indicating like components, except that only a single winding is shown instead of two windings 38, 39.

What is claimed is:

1. A fuel injector comprising a valve needle slidable within a bore, a surface associated with said valve needle defining, in part, a control chamber which communicates, through a restriction, with a supply passage, an injection control valve controlling communication between said control chamber and a low pressure reservoir, and a drain valve controlling communication between said supply passage and said low pressure reservoir, wherein said injection control valve and said drain valve include respective armatures moveable under the influence of a common electromagnetic actuator, the fuel injector further comprising an abutment member which defines said surface associated with said valve needle, wherein said abutment member is arranged such that, in use, when said injection control valve is closed, fuel leakage from said control chamber to said low pressure reservoir is minimized.

2. The fuel injector as claimed in claim 1, wherein said actuator includes separate windings which are energizable independently to cause movement of said armatures.

3. The fuel injector as claimed in claim 1, wherein said actuator includes a single winding, energization of said winding to different levels causing movement of the armatures.

4. The fuel injector as claimed in claim 1, the actuator and the armature associated with the injection control valve having a magnetic attractive force therebetween, wherein said injection control valve and said actuator are arranged such that, in use, said injection control valve opens when fuel pressure within said control chamber exceeds a predetermined level determined by the attractive force between the actuator and the armature associated with the injection control valve, said injection control valve thereby serving to regulate said control chamber pressure.

5. The fuel injector as claimed in claim 4, wherein said injection control valve takes the form of a tubular member, the actuator having a surface with which said tubular member is engageable to control communication between said control chamber and said low pressure reservoir.

6. A fuel injector comprising a valve needle slidable within a bore, a surface associated with said valve needle defining, in part, a control chamber which communicates, through a restriction, with a supply passage, an injection control valve controlling communication between said control chamber and a low pressure reservoir, and a drain valve controlling communication between said supply passage and said low pressure reservoir, wherein said injection control valve and said drain valve include respective armatures movable under the influence of a common electromagnetic actuator comprising a single winding or respective windings associated with the injection control valve and the drain valve respectively, said injection control valve being arranged such that, in use, said injection control valve opens upon de-energization of the single or the respective winding to allow fuel pressure within said control chamber to fall, thereby allowing injection to commence.

7. The fuel injector as claimed in claim 6, wherein said actuator includes separate windings which are energizable independently to cause movement of said armatures.

8. The fuel injector as claimed in claim 6, wherein said actuator includes a single winding, energization of said winding to different levels causing movement of the armatures.

9. The fuel injector as claimed in claim 6, wherein said injection control valve is slidable within a bore and is engageable with a seating defined by said bore to control communication between said control chamber and said low pressure reservoir.

10. The fuel injector as claimed in claim 6, including an abutment member which defines said surface associated with said valve needle, wherein said abutment member is arranged such that, in use, when said injection control valve is closed, fuel leakage from said control chamber to said low pressure reservoir is minimized.

11. A fuel injector comprising a valve needle slidable within a bore, a surface associated with said valve needle defining, in part, a control chamber which communicates, through a restriction, with a supply passage, an injection control valve controlling communication between said control chamber and a low pressure reservoir, and a drain valve controlling communication between said supply passage and said low pressure reservoir, wherein said injection control valve and said drain valve include respective armatures moveable under the influence of a common electromagnetic actuator, said actuator including separate windings which are engergizable independently to cause movement of said armatures and wherein said injection control valve is arranged such that, in use, said injection control valve opens upon partial deengergization of the respective winding to allow fuel pressure within said control chamber to fall, thereby allowing injection to commence.

12. The fuel injector as claimed in claim 11, wherein said injection control valve is slidable within a bore and is engageable with a seating defined by said bore to control communication between said control chamber and said low pressure reservoir.

13. The fuel injector as claimed in claim 4, including an abutment member which defines said surface associated with said valve needle, wherein said abutment member is arranged such that, in use, when said injection control valve is closed, fuel leakage from said control chamber to said low pressure reservoir is minimized.

14. The fuel injector as claimed in claim 11, the actuator and the armature associated with the injection control valve having a magnetic attractive force therebetween, wherein said injection control valve and said actuator are arranged such that, in use, said injection control valve opens when fuel pressure within said control chamber exceeds a predetermined level determined by the attractive force between the actuator and the armature associated with the injection control valve, said injection control valve thereby serving to regulate said control chamber pressure.

15. The fuel injector as claimed in claim 14, wherein said injection control valve takes the form of a tubular member, the actuator having a surface with which said tubular member is engageable to control communication between said control chamber and said low pressure reservoir.

* * * * *